US005732958A

United States Patent [19]

Liu

[11] Patent Number: 5,732,958

[45] Date of Patent: Mar. 31, 1998

[54] FRAME FOR AN IN-LINE ROLLER SKATE

[76] Inventor: Han Ching Liu, No.408,Ding-Lin Rd., Chu-San,Nan Tou Hsien, Taiwan

[21] Appl. No.: 808,954

[22] Filed: Feb. 19, 1997

[51] Int. Cl.[6] ..... A63C 17/04

[52] U.S. Cl. ..... 280/11.22; 280/11.27

[58] Field of Search ..... 280/11.19, 11.22, 280/11.23, 11.27, 11.28, 87.042; 296/187, 188

[56] References Cited

U.S. PATENT DOCUMENTS

| | | | |
|---|---|---|---|
| 4,666,168 | 5/1987 | Hamill et al. | 280/11.27 |
| 5,092,614 | 3/1992 | Malewicz | 280/11.27 |
| 5,277,437 | 1/1994 | Moats | 280/11.27 |

*Primary Examiner*—Richard M. Camby
*Attorney, Agent, or Firm*—Bacon & Thomas

[57] ABSTRACT

A frame for an in-line roller skate includes an inverted U-shaped outer case and an inner member, each of two side plates of the outer case having a series of continuous enforced portions extending laterally therefrom wherein each of the enforced portions has a thickness thicker than that of an upper plate of the outer case. Each of the enforced portions has a hole defined therethrough. The inner member has a plurality of recesses defined in an under side thereof and is securely disposed between the two side walls of the outer case with each of the recesses of the inner member being located between the two enforced portions of the respective side wall of the outer case.

4 Claims, 3 Drawing Sheets

FRAME FOR AN IN-LINE ROLLER SKATE

BACKGROUND OF THE INVENTION

1. Field of the Invention

The present invention relates to a frame for an in-line roller skate and, more particularly, to an improved frame of an in-line roller skate and which comprises an inverted U-shaped outer case made of compound composite material and an inner member integrally connected between two side walls of the outer case.

2. Brief Description of the Prior Art

A conventional frame of an in-line roller skate generally has an inverted U-shaped cross section and is made of metal or plastic which has to provide a sufficient strength to have rollers rotatably disposed thereto. A shortcoming of this type of conventional frame is that it has a weight much more than expected. In order to enforce the structural strength of the frame, a lots of bridges are connected transversely between two side walls of the frame so that the two side walls of the frame will not be bent inwardly. However, the bridges must be disposed to the frame by an additional manufacturing process after the frame is prepared and this takes time and increases the total weight of the frame.

The present invention intends to provide an improved frame for an in-line roller skate and which has a light weight and an excellent structural strength such that the above-mentioned problems are mitigated and/or obviated.

SUMMARY OF THE INVENTION

The present invention provides a frame for an in-line roller skate and which includes an inverted U-shaped outer case including an upper plate and two side walls extending downwardly from opposite sides of the upper plate and an inner member. Each of the side plates has a series of enforced portions extending laterally therefrom and a hole is defined in each of the enforced portions. An thickness of each of the enforced portions is thicker than that of the upper plate.

The inner member has a plurality of recesses defined in an under side thereof and is securely disposed between the two side walls of the outer case with each of the recesses of the inner member being located between the two enforced portions of the respective side wall of the outer case.

it is an object of the present invention to provide a frame for an in-line roller skate and which has a light weight.

It is another object of the present invention to provide a frame for an in-line roller skate and which includes a compound composite material made outer case and a foam material made inner member.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
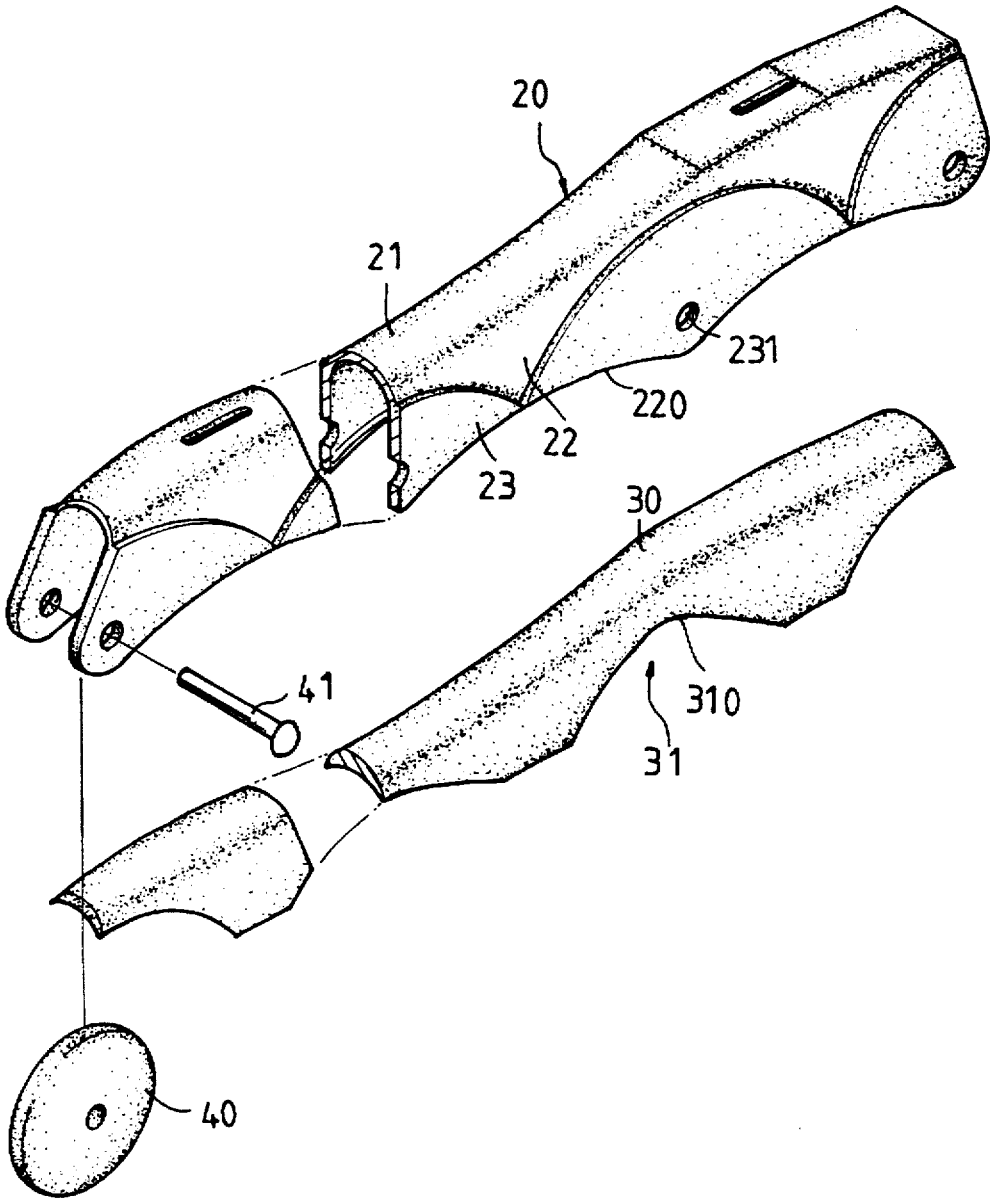
FIG. 1 is an exploded view of a frame for an in-line roller skate in accordance with the present invention.
Figure 2:
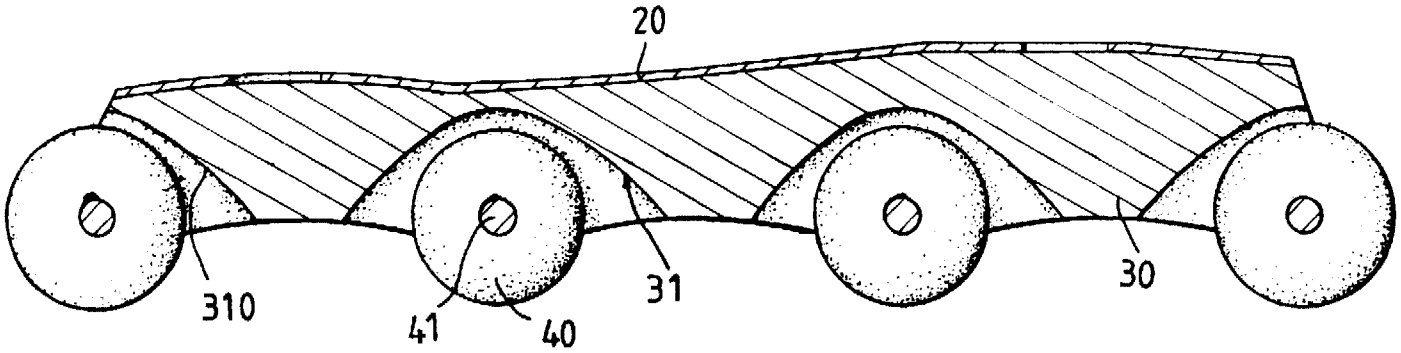
FIG. 2 is a side elevational view, partly in section, of the frame in accordance with the present invention.
Figure 3:
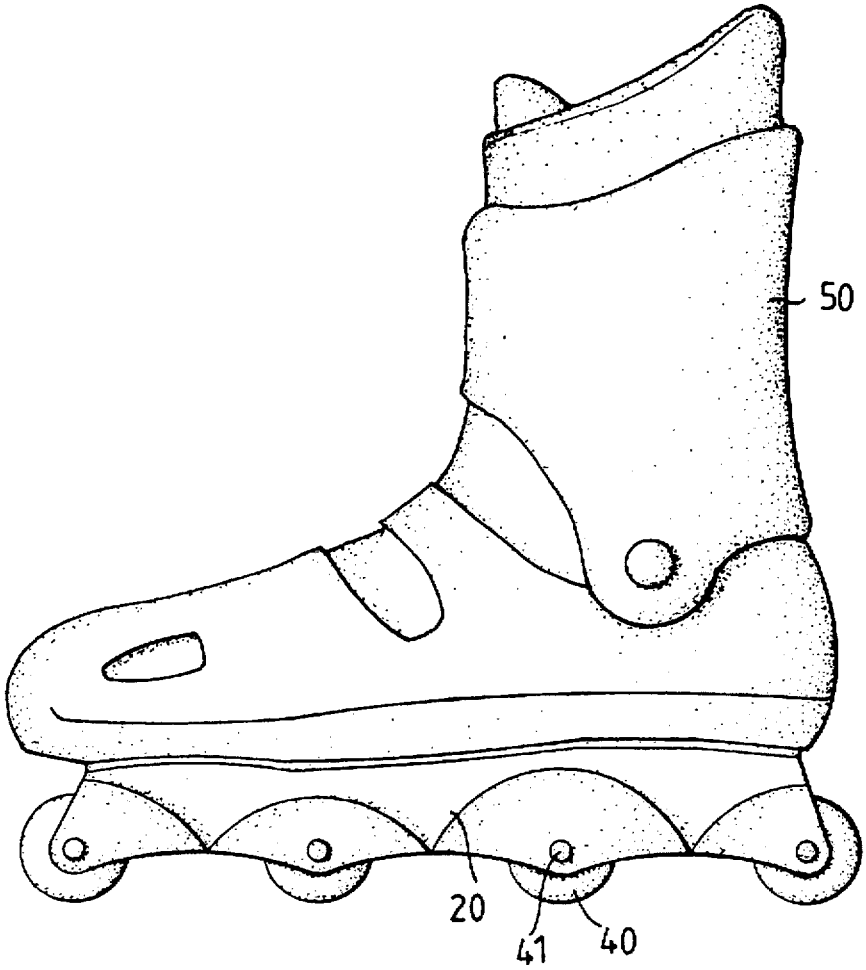
FIG. 3 is a side elevational view of the frame disposed to a boot.

Referring to FIGS. 1 through 3, a frame 10 is disposed to an under side of a boot 50 as shown in FIG. 3, the frame in accordance with the present invention generally includes an outer case 20 having an inverted U-shaped cross section and including an upper plate 21 and two side walls 22 extending downwardly from two opposite sides of the upper plate 21. Each of the side plates 22 has a series of enforced portions 23 extending laterally therefrom and each of the enforced portions 23 has a thickness thicker than that of the upper plate 21. Each of the enforced portions 23 has a hole 231 defined therethrough so that rollers 40 are rotatably disposed between the two side walls 22 by rivets 41. Each of the side walls 22 of the outer case 20 has an arcuate lower edge 220 defined between each two adjacent holes 231.

An inner member 30 is a longitudinal member and has a plurality of recesses 31 defined in an under side thereof and each of the recesses 31 is defined by an arcauted periphery 310. The inner member 30 is securely disposed between the two side walls 22 of the outer case 20 with each of the recesses 31 of the inner member 30 being located between the two enforced portions 23 of the respective side wall 22 of the outer case 20.

The outer case 20 is made of compound composite material and the inner member 30 is made of foam material which is disposed between the two side walls 22 in a mold (not shown) when manufacturing the frame so that when the mold is heated, the compound composite material is solidified and the foam material expands within the mold to form the frame.

The frame has a light weight and the arcuate lower edges 220 not only form an aesthetic outer-looking, but also enforce the structural strength of the frame.

Although the invention has been explained in relation to its preferred embodiment, it is to be understood that many other possible modifications and variations can be made without departing from the spirit and scope of the invention as hereinafter claimed.

What is claimed is:

1. A frame for an in-line roller skate comprising:

an outer case having an inverted U-shaped cross section and including an upper plate and two side walls extending downwardly from two opposite sides of said upper plate, each of said side plates having a series of enforced portions extending laterally therefrom wherein each of said enforced portions has a thickness thicker than that of said upper plate, each of said enforced portions having a hole defined therethrough, and an inner member being a longitudinal member and having a plurality of recesses defined in an under side thereof, said inner member securely disposed between said two side walls of said outer case with each of said recesses of said inner member being located between said two enforced portions of said respective side wall of said outer case.

2. The frame as claimed in claim 1 wherein said outer case is made of compound composite material and said inner member is made of foam material.

3. The frame as claimed in claim 1 wherein each of said side walls of said outer case has an arcuate lower edge defined between each two adjacent holes.

4. The frame as claimed in claim 1 wherein each of said recesses of said inner member is defined by an arcauted periphery.

* * * * *